US005952143A

United States Patent [19]

Ootaki et al.

[11] Patent Number: 5,952,143

[45] Date of Patent: Sep. 14, 1999

[54] CARRIER FOR DEVELOPING ELECTROSTATIC LATENT IMAGE AND MANUFACTURING METHOD THEREOF

[75] Inventors: Kazumi Ootaki, Shizuoka-ken; Yasuyuki Sanui; Yasuo Suzuki, both of Numazu, all of Japan

[73] Assignee: Ricoh Company, Ltd., Yokohama, Japan

[21] Appl. No.: 09/052,250

[22] Filed: Mar. 31, 1998

[30] Foreign Application Priority Data

Jul. 29, 1997 [JP] Japan ..... 9-217030

[51] Int. Cl.[6] ..... G03G 9/113

[52] U.S. Cl. ..... 430/108; 430/106.6; 430/137

[58] Field of Search ..... 430/108, 137

[56] References Cited

U.S. PATENT DOCUMENTS

| | | | |
|---|---|---|---|
| 5,204,204 | 4/1993 | Shintani et al. | 430/108 |
| 5,272,037 | 12/1993 | Ohtani et al. | 430/137 |
| 5,554,477 | 9/1996 | Ozawa et al. | 430/108 |
| 5,670,287 | 9/1997 | Kawata et al. | 430/137 |

FOREIGN PATENT DOCUMENTS

| | | | |
|---|---|---|---|
| 56-19059 | 2/1981 | Japan | 430/108 |
| 2-146061 | 6/1990 | Japan | 430/108 |
| 2-187770 | 7/1990 | Japan | 430/108 |
| 6-194882 | 7/1994 | Japan | 430/108 |

*Primary Examiner*—Roland Martin
*Attorney, Agent, or Firm*—Oblon, Spivak, McClelland, Maier & Neustadt, P.C.

[57] ABSTRACT

A carrier for a two-component developer for electrostatic latent images which comprises carrier particles whose surfaces are coated with a resin layer comprising a thermosetting resin, wherein the resin layer formed on convex parts of the carrier particles is relatively thin compared to that formed on the concave parts, and wherein the ratio of the total area of the thin resin layer to the total surface area of the carrier particles is from about 55% to about 90%. The resin coated carrier is manufactured by a coating liquid including the thermosetting resin on carrier particles and drying the coated liquid by either a dip coating, a spray coating or a drip coating method, under reduced pressure while heating.

14 Claims, 4 Drawing Sheets

CARRIER FOR DEVELOPING ELECTROSTATIC LATENT IMAGE AND MANUFACTURING METHOD THEREOF

BACKGROUND OF THE INVENTION

1. Field of the Invention

The present invention relates to a carrier useful for a developer which can develop electrostatic latent images, and more particularly to a resin-coated carrier useful for an electrophotographic two-component developer and manufacturing method thereof.

2. Discussion of the Background

Among methods of developing electrostatic latent images using toner, a cascade developing method (U.S. Pat. No. 2,618,552) and a magnetic brush developing method (U.S. Pat. No. 2,874,063) are well known. Both of these developing methods use a two-component developer. A two-component developer includes a carrier which has relatively large particles and a toner which has relatively small particles which are retained on the surface of the carrier particles by electric forces, caused by friction between the toner particles and the carrier particles. When the two-component developer approaches an electrostatic latent image, a force that is caused by an electric field associated with the latent image and which attracts the toner particles toward the latent image becomes greater than the binding force of the toner particles and the carrier the toner particles are attracted to the latent image, resulting in visualization of the latent image. The developer is used repeatedly by being replenished with an amount of toner commensurate with the amount of toner spent for developing latent images. In this case, the toner particles should have a desired polarity and electric charge to be securely attracted to latent images. In addition, the carrier should continuously charge the toner particles as long as the carrier is used in the developer, so that the toner particles have the desired polarity and electric charge.

Further, a carrier that is used in the magnetic brush developing method should be appropriately magnetizable. Therefore, an iron powder carrier, a ferrite carrier, and a binder-type carrier which has resin particles including fine magnetizable particles are developed and utilized as a carrier for a magnetic brush developing method.

However, these carriers cause a problem in which toner particles adhere to the surface of the carrier when developing operations are repeatedly performed, resulting in a change of surface resistivity of the carrier, and, thereby, image qualities deteriorate (hereinafter referred to as the spent-carrier problem). Thus developers including these carriers have the problem of a short life.

In attempting to solve the spent-carrier problem, an iron powder carrier whose surface is coated with a resin is used, however the problem cannot be solved. This is because the iron carrier tends to deteriorate by receiving large stress due to its large true specific gravity when it is agitated in a developing unit. A ferrite carrier is spherical, and has a relatively small true specific gravity of from 4.5 to 5.5 and a relatively large bulk density of from 2 to 3 g/ml compared to the iron powder carrier, and therefore the spent-carrier problem is improved to some extent. However, even ferrite carriers are not satisfactory when used for developers in high speed copiers or printers in which developing sleeves or magnets in the sleeves rotate at high speed. In addition, carriers in which a variety of resins are coated on the surface thereof have been disclosed, however the resultant carriers cannot solve this problem.

Materials whose surfaces have low critical surface tension, for example, polytetrafluoroethylene and silicone resins, have been proposed as coating resins for the surface of the carrier. Although polytetrafluoroethylene can improve the spent carrier problem, it has a drawback that it cannot be used for a developer in which a toner is desired to be negatively charged because it has large negative polarity. Silicone resins can also improve the spent-carrier problem, however, they have a drawback in that a carrier having surfaces coated with silicone resins have a large resistivity which causes the so-called edge effect (a phenomenon that image density of a center part of a large solid image is lighter than that of an edge part thereof) in developed images, resulting in deterioration of the reproducibility of solid images and half-tone images. In addition, carrier particles having surfaces coated with silicone resins have a large counter charge when toner particles are released from the carrier particles, and, therefore, the carrier particles tend to be attracted to latent images particularly when a high bias voltage is applied for developing latent images.

In attempting to solve these problems, carriers having surfaces coated with a silicone resin including an electroconductive material such as carbon black have been disclosed, for example Japanese Laid-Open Patent Publication No. 56-126843 and a carrier whose surface is coated with a resin including porous carbon black, Japanese Laid-Open Patent Publication No. 62-45984. However, these carriers have a drawback that the carbon black in the coating layers of the carriers tends to release from the coating layers when the carriers are mixed with the toner or when developers including the carrier are continuously used for developing latent images, resulting in contamination of developing sleeves, photoconductors or the entire inside of the copy machine.

In addition, when these carriers are used for developers including a color toner, the released carbon black and the color toner are mixed, resulting in occurrence of a problem in which a developed image becomes a dark color. In attempting to solve this dark color image problem, a carrier having a coating layer including a white metal oxide has been proposed. For example, Japanese Laid-Open Patent Publication No. 64-35561 discloses a carrier having a silicone resin coating layer including one or more metal oxides of titanium oxide, zinc oxide and tin oxide. When a silicone resin including these conductive materials is coated on the surface of a ferrite type carrier, the spent-carrier problem can be improved and resistivity of the carrier can be easily varied, however high copy qualities, such as reproducibility of photographs or fine lines, which are now desired in the marketplace, cannot be obtained yet.

In order to achieve high copy qualities, the particle sizes of toner and carrier become finer and finer. When conductive materials are included in the coating layers of such fine carriers, they should have such a fine particle size as carbon black, and therefore need an additional pulverizing process of the conductive materials to make the coated carrier, resulting in higher manufacturing costs. When these fine conductive materials are included in a carrier coating liquid, the viscosity of the coating liquid seriously increases and therefore a problem occurs in which the coating cannot be performed by the spray coating method. Therefore carriers whose surfaces are coated with a thin resin layer without including these conductive materials are disclosed in, for example, Japanese Laid-Open Patent Publications No. 4-40472, 3-233464 and 7104522. These carriers have a drawback in that carriers coated with a thin resin layer do not have low resistivity, or if a carrier having low resistivity can be obtained, durability of the carrier deteriorates when used for continuous duplication.

Further, a coated carrier in which only a projected part of the carrier is not coated with a resin is disclosed in Japanese Laid-Open Patent Publication No. 4-93954, however it is difficult to obtain such carriers by the method proposed therein such as a fluidized bed type coating method, and if the carriers can be obtained, toner particles tend to adhere to the projected parts, resulting in occurrence of the spent-carrier problem.

Because of these reasons, a need exists for a carrier useful for a developer capable of developing electrostatic latent images which has low volume resistivity, high durability and which can produce images haying good image qualifies without undesirably making color images dark.

SUMMARY OF THE INVENTION

Accordingly, an object of the present invention is to provide a carrier useful for a developer capable of developing electrostatic latent images which has low volume resistivity of from about $10^8$ to about $10^{14}$ Ω·cm, high durability and which can produce images having good image qualities without undesirably making color images dark.

Another object of the present invention is to provide a method for manufacturing the carrier of the present invention.

Briefly this object and other objects of the present invention can be attained by a carrier having the following characteristics: (1) the carrier particle has convex parts on which a relatively thin resin layer is formed, and concave parts on which a relatively thick resin layer is formed compared to the thin resin layer of the convex parts, and the area of the thin layer parts relative to the total area of the surface of the carrier particle (hereinafter referred to as a thin layer rate) is from about 55% to about 90%; and (2) the ratio of the thickness of the thick resin layer formed on the concave parts to that of the thin layer formed on the convex parts (hereinafter referred to as the layer thickness ratio) is from about 2/1 to about 100/1.

The resin layer preferably includes a crosslinked silicone resin.

In addition, the spectrum intensity (Abs mode) of absorbance of chloroform-soluble components of the resin coated carrier in an infrared range of from 1000 to 1200 $cm^{-1}$ in wave number is preferably greater than about 0.8, and each of those in infrared ranges of from 1200 to 1300 and from 700 to 900 $cm^{-1}$ in wave number is preferably greater than about 0.45.

The carrier is manufactured, for example, by a method in which carrier particles are coated with a coating liquid including a thermosetting resin by a dip coating method, a spray coating method or a drip coating method and then dried, wherein the coating and drying operations are performed under reduced pressure while heating.

Various other objects, features and attendant advantages of the present invention will be more fully appreciated as the same becomes better understood from the detailed description when considered in connection with the accompanying drawings in which like reference characters designate like corresponding parts throughout.

DETAILED DESCRIPTION OF THE INVENTION

Figure 1A:
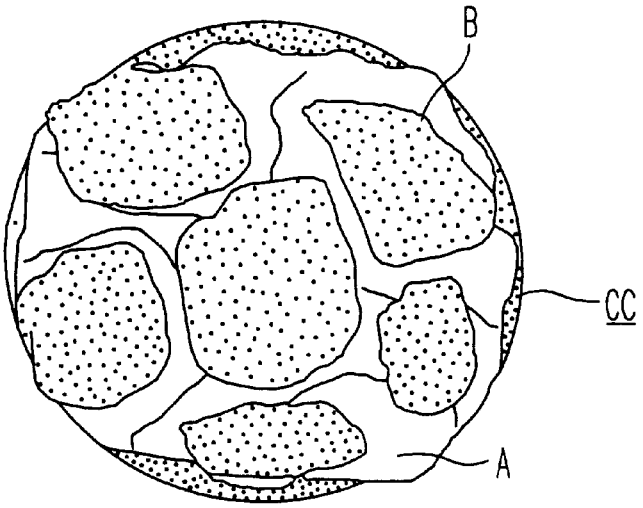
FIG. 1*a* is a schematic view illustrating the surface of a resin coated carrier of the present invention.
Figure 1B:
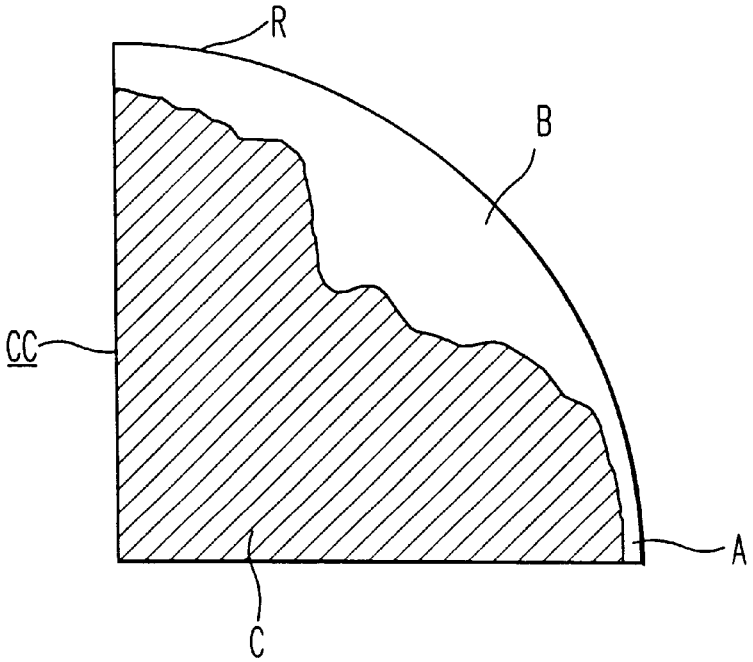
FIG. 1*b* is schematic view illustrating a partial cross section of a resin coated carrier of the present invention.

Generally, the present invention provides a coated carrier useful for developing electrostatic latent images which has low volume resistivity of from $10^8$ to $10^{14}$ Ωcm, high durability, and which can produce copies having good image qualities without undesirably making color images dark. The coated carrier can be obtained by controlling the thin layer rate and the layer thickness ratio, so as to be from about 55% to about 90% and from about 2/1 to 100/1, respectively. FIG. 1*a* is a schematic view illustrating the surface of a coated carrier particle, a resin-coated carrier CC of the present invention. Reference numerals A and B respectively represent a thin layer part and a thick layer part of a resin layer formed on a carrier particle. FIG. 1*b* is a schematic view illustrating a partial cross section of the coated carrier CC of the present invention and reference numeral C and R represent a carrier particle and a resin layer, respectively. As can be understood from FIG. 1*b*, the coated carrier particles of the present invention have an uneven resin layer thereon. The thickness of the resin layer formed on a convex part of the carrier particles is thin and the thickness of the resin layer formed on a concave part is thick.

Figure 2:
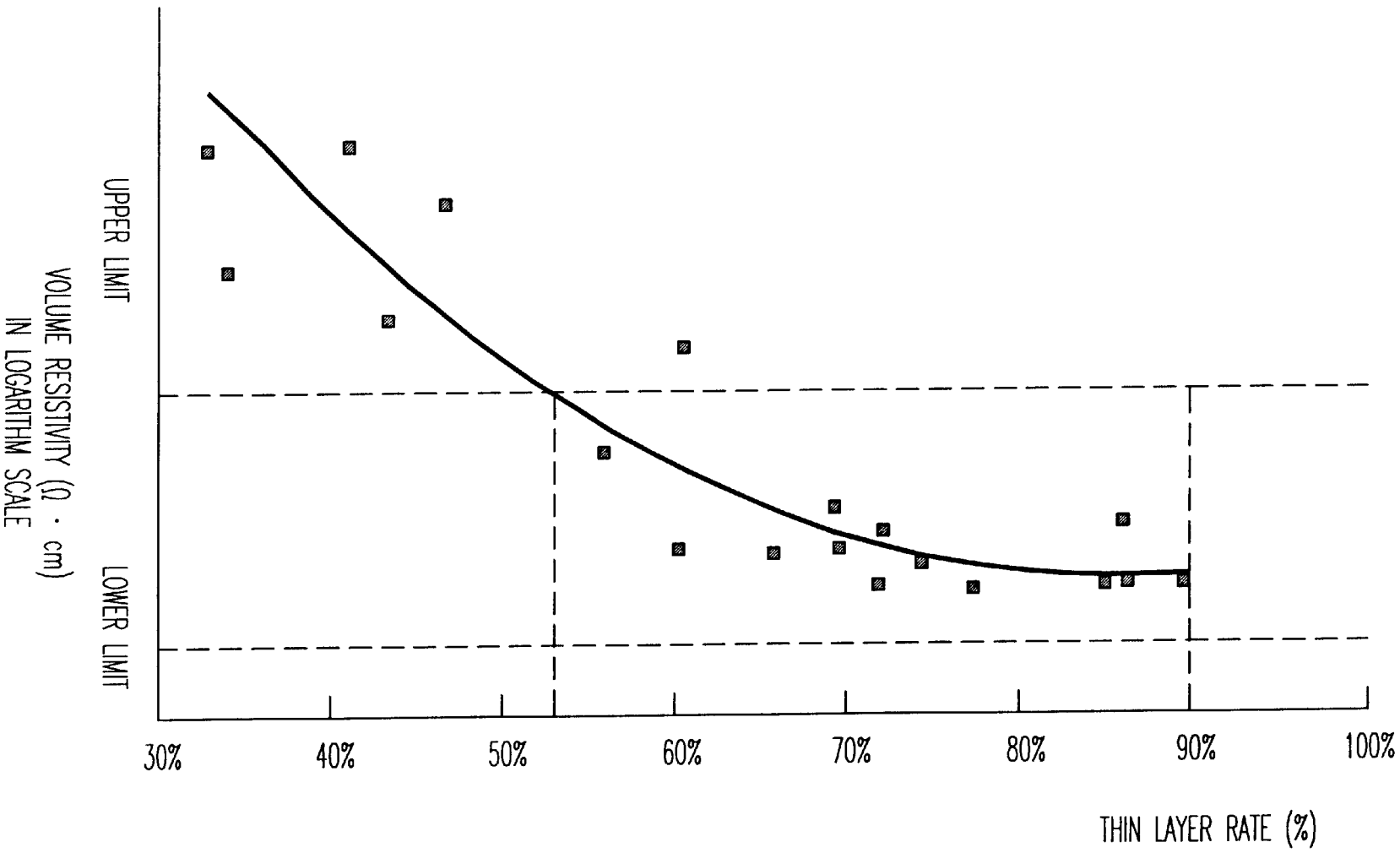
FIG. 2 is a graph illustrating the relationship between the thin layer rate of a resin coated carrier and the volume resistivity thereof.

FIG. 2 is a graph illustrating the relationship between the thin layer rate of a coated carrier and volume resistivity thereof in logarithmic scale. It can be understood from FIG. 2 that the thin layer rate is preferably controlled from about 55% to about 90%. Namely a carrier having low volume resistivity of the present invention can be obtained when the thin layer rate are controlled from about 55% to about 90% and more preferably from about 65% to about 75%. When the thin layer rate is greater than the upper limit, the charging ability of the coated carrier tends to deteriorate, resulting in occurrence of undesired images such as fouling in background areas of developed images. When the thin layer rate is less than the lower limit, the volume resistivity of the coated carrier increases, resulting in excessive charging of the coated carrier, and thereby problems occur in which image density of developed images decreases and undesired images such as edge effect tend to be produced.

The layer thickness ratio of the resin layer formed on the carrier is preferably from about 2/1 to about 100/1, and more preferably from about 5/1 to about 100/1. Since carrier particles contact each other at almost every convex part, the carrier particles of the present invention contact each other through their thin layer parts, and thereby the carrier can exhibit low volume resistivity. When the layer thickness of the resin layer on the convex part is greater than that of the concave part, the volume resistivity of the coated carrier tends to increase. On the other hand, when the layer thickness of the resin layer formed on the convex part is much thinner than that formed on the concave part, the carrier particles tends to expose their surface when used for developing for a long period of time, and thereby the spent-toner problem occurs. As mentioned above, the coated carrier of the present invention having low volume resistivity can be obtained by controlling the thin layer rate in an appropriate range.

A thin layer part and a thick layer part are identified, for example, by mapping distribution of silicon atoms of a coated carrier particle using an X-ray micro-analyzer (EPMA). In a thick layer part, the intensity of detected X-ray is larger than that from a thin layer part.

The mapped micrograph is then translated into an image in which the thick layer part and the thin layer part is identified by being differently colored using a computer. In addition, a micrograph of particle cross section of the coated carrier is taken to determine the thickness of the thick layer part and the thin layer part, namely to obtain the layer thickness ratio.

In order to obtain data with high accuracy, cross sectional micrographs of ten particles of a coated carrier are taken and the thickness of ten positions of each of the thick and thin layer parts are measured, and then the data are averaged. The colored image of the coated carrier is then translated into a black and white image so that a black image represents the thick film part whose thickness is five or more times as thick as the averaged thickness of the thin layer part. A total area of the black images of the coated carrier is measured using an image analyzer. The black and white image is translated into a solid image to obtain a total area of the coated carrier. A total area of the thin layer part of the coated carrier is obtained by subtracting the area of the thick layer part from the total area of the coated carrier. The thin layer rate can be obtained by dividing the area of the thin layer part of the coated carrier by the total area of the coated carrier. In measurements of the areas, sampling is performed five times per each particle of the coated carrier.

Figure 3:
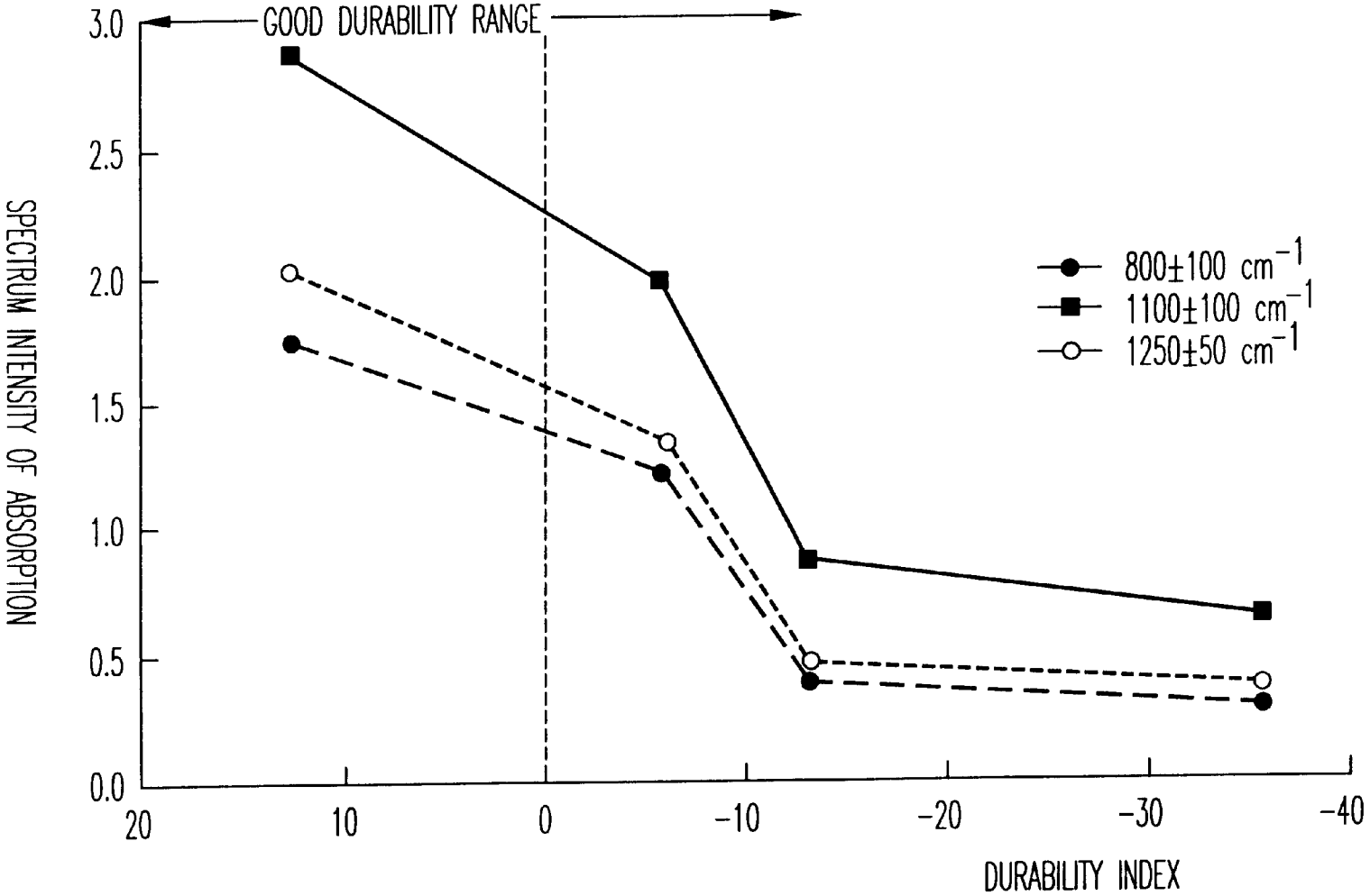
FIG. 3 is a graph illustrating a relationship between the spectrum intensity of absorbance of chloroform-soluble components of a coated carrier in three infrared ranges and durability of the coated carrier.

FIG. 3 is a graph illustrating the relationship between spectrum intensity (Abs mode) of the absorbance of chloroform soluble components of a coated carrier, in each infrared range of from 700 to 900 $cm^{-1}$, from 1000 to 1200 $cm^{-1}$ and from 1200 to 1300 $cm^{-1}$ in wave number, and durability of the coated carrier. In FIG. 3, the durability index is determined by the following method:

(1) a developer including a toner and a carrier is prepared and a charging amount thereof is measured;

(2) the developer is set in a copier, PRETER 550 manufactured by Ricoh Co., Ltd. and an image forming operation is continuously repeated 800,000 times;

(3) after the continuous image forming operations, the developer is subjected to blow-off treatment to obtain the used carrier without the toner;

(4) a new developer is prepared in the same way as performed in (1) using a new one of the toner and the used carrier obtained in (3), and the charging amount of the new developer is also measured;

(5) the ratio of the charging amount of the new developer to that of the initial developer before image forming operations is obtained;

(6) the ratios are ranked to obtain a durability index such that the index is 0 when the ratio is 1. The smaller than 1 the ratio becomes, the larger negative value the index becomes, and the larger than 1 the ratio becomes, the larger positive value the index becomes; and (7) when the index is between −12 to +20, the carrier has good durability.

As can be understood from FIG. 3, a coated carrier has good durability when the spectrum intensity of absorbance of chloroform-soluble components of a coated carrier in the infrared range of from 1000 to 1200 $cm^{-1}$ in wave number is greater than about 0.8. In addition, a coated carrier also has good durability when the spectrum intensity of absorbance of chloroform-soluble components of a coated carrier in the infrared range of from 700 to 900 $cm^{-1}$ or from 1200 to 1300 $cm^{-1}$ in wave number is greater than about 0.45.

The reason is thought to be that when the spectrum intensity is less than the lower limit, the formed resin layer becomes hard. In that case, when a point on the surface of the resin layer is stressed, silanol groups of the silane coupling agent included in the resin layer formed on the coated carrier tends to get broken, and thereby the resin layer wears off easily. Resin particles released from the resin layer are transferred to images together with toner particles, resulting in undesired images such as fouling in the background areas of developed images and deterioration of the fixing properties of developed images. In addition, the resin particles released from the resin layer deteriorate the charging properties of toner particles. Further, when the resin layer is worn off, the spent-carrier problem occurs.

Next, materials for use in the coated carrier of the present invention are described.

Suitable resins for use in the resin layer formed on the carrier of the present invention include known resins, and preferably silicone resins. When a silicone resin is coated on a carrier such that the thin layer rate and the layer thickness ratio are in their preferred ranges, a carrier having the desired volume resistivity can be obtained if the carrier does not include an electroconductive agent in the resin layer, which causes a dark-colored image problem.

Suitable silicone resins include unmodified silicone resins, and modified silicone resins such as alkyd-modified, polyester-modified, epoxy-modified, and urethane-modified silicone resins, all of which are known.

Specific examples of such silicone resins include compounds having formula (1):

(1)

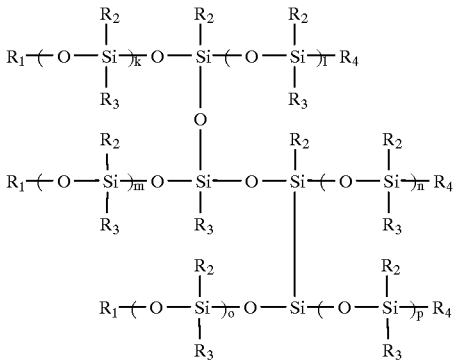

wherein $R_1$ represents a hydrogen atom, an alkyl group having carbon atoms of from 1 to 4, or a phenyl group; $R_2$ and $R_3$ independently represent a hydrogen atom, an alkyl group having from 1 to 4 carbon atoms, an alkoxy group having from 1 to 4 carbon atoms, a phenyl group, an alkenyl group having carbon atoms of from 2 to 4, an alkenyloxy group having carbon atoms of from 2 to 4, a hydroxy group, a carboxyl group, an ethylene oxide group, a glycidyl group or a group having the formula (2):

(2)

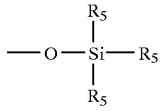

wherein $R_4$ and $R_5$ independently represent a hydroxy group, a carboxyl group, an alkyl group having carbon atoms of from 1 to 4, an alkoxy group having carbon atoms of from 1 to 4, an alkenyl group having carbon atoms of from 2 to 4, an alkenyloxy group having carbon atoms of from 2 to 4, a phenyl group, or a phenoxy group; and k, l, m, n, o, and p are independently each a positive integer.

The groups mentioned above may be substituted by an amino group, a hydroxy group, a carboxyl group, a mercapto group, an alkyl group, a phenyl group, an ethylene oxide group or a halogen atom. Specific examples of the silicone resins on the market include unmodified silicone resins such as KR271, KR255 and KR 152 each of which is manufactured by Shin-Etsu Chemical Co. Ltd., and SR2400 and SR2405, each of which is manufactured by Dow Corning-Toray Silicone Co., Ltd., and modified silicone resins such as KR206 (alkyd modified), KR5208 (acryl modified), ES1001N (epoxy modified) and KR305 (urethane modified), each of which is manufactured by Shin-Etsu Chemical Co.Ltd., and SR2115 (epoxy modified) and SR2110 (alkyd modified), each of which is manufactured by Dow Corning-Toray Silicone Co., Ltd.

When a silicone resin including a coupling agent is used for the resin layer formed on a carrier, the resin coated carrier has relatively low resistivity compared to a resin coated carrier having a resin layer without a coupling agent. Suitable coupling agents include silane coupling agents, titanium coupling agents, aluminum coupling agents and the like. By including a specified silane coupling agent in the resin layer, the following advantages can be obtained:

(1) adhesion between the resin layer and the carrier is good and therefore a carrier having good durability can be obtained;

(2) a good developer in which a toner is uniformly and negatively charged can be obtained because the coated carrier is uniformly and positively charged by including a silane coupling agent having an amino group in the resin layer; and (3) a good developer in which the toner is uniformly and positively charged can be obtained because the coated carrier is uniformly and negatively charged by including a silane coupling agent having a group including a chlorine atom or a glycidoxy group in the resin layer.

Specific examples of such silane coupling agents include γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyltrimethoxysilane, methyltriethoxysilane, vinyltriacetoxysilane, γ-chloropropyl trimethoxysilane, hexamethyl disilazane, γ-anilinopropyl trimethoxysilane, vinyltrimethoxysilane, octadecyldimethyl{3(trimethoxysilyl)propyl}ammonium chloride, γ-chloropropylmethyl dimethoxysilane, methyltrichlorosilane, dimethyldichlorosilane, and trimethylchlorosilane each of which is manufactured by Toray Silicone Industries Inc., and allyltriethoxysilane, 3-aminopropylmethyl diethoxysilane, 3-aminopropyl trimethoxysilane, dimethyldiethoxysilane, 1,3-divinyltetramethyldisilazane, and methacryloxyethyldimethyl(3-trimethoxysilylpropyl) ammonium chloride each of which is manufactured by Chisso Co., Ltd.

The mixing ratio of the silane coupling agent is preferably from about 1 to 25 parts by weight per 100 parts by weight of the total solid amount of silicone resins included in the resin layer to maintain good adhesion of the resin layer to the carrier and to avoid occurrence of the spent-toner problem.

Suitable materials for use as the carrier in the present invention include known materials such as ferrites, iron powders, magnetites and the like, and particle size thereof is not particularly limited.

The average thickness of the resin layer of the coated carrier of the present invention is preferably about 0.1 to about 3 μm.

The coated carrier can be obtained by a method in which carrier particles having any particle size are coated with a coating liquid, mainly including a thermosetting resin, by any coating method and then dried, wherein the coating and drying operations are performed under reduced pressure while heating.

Suitable coating methods include the dip coating method, the spray coating method, the drip coating method or the like, and the following method is preferable.

Figure 4:
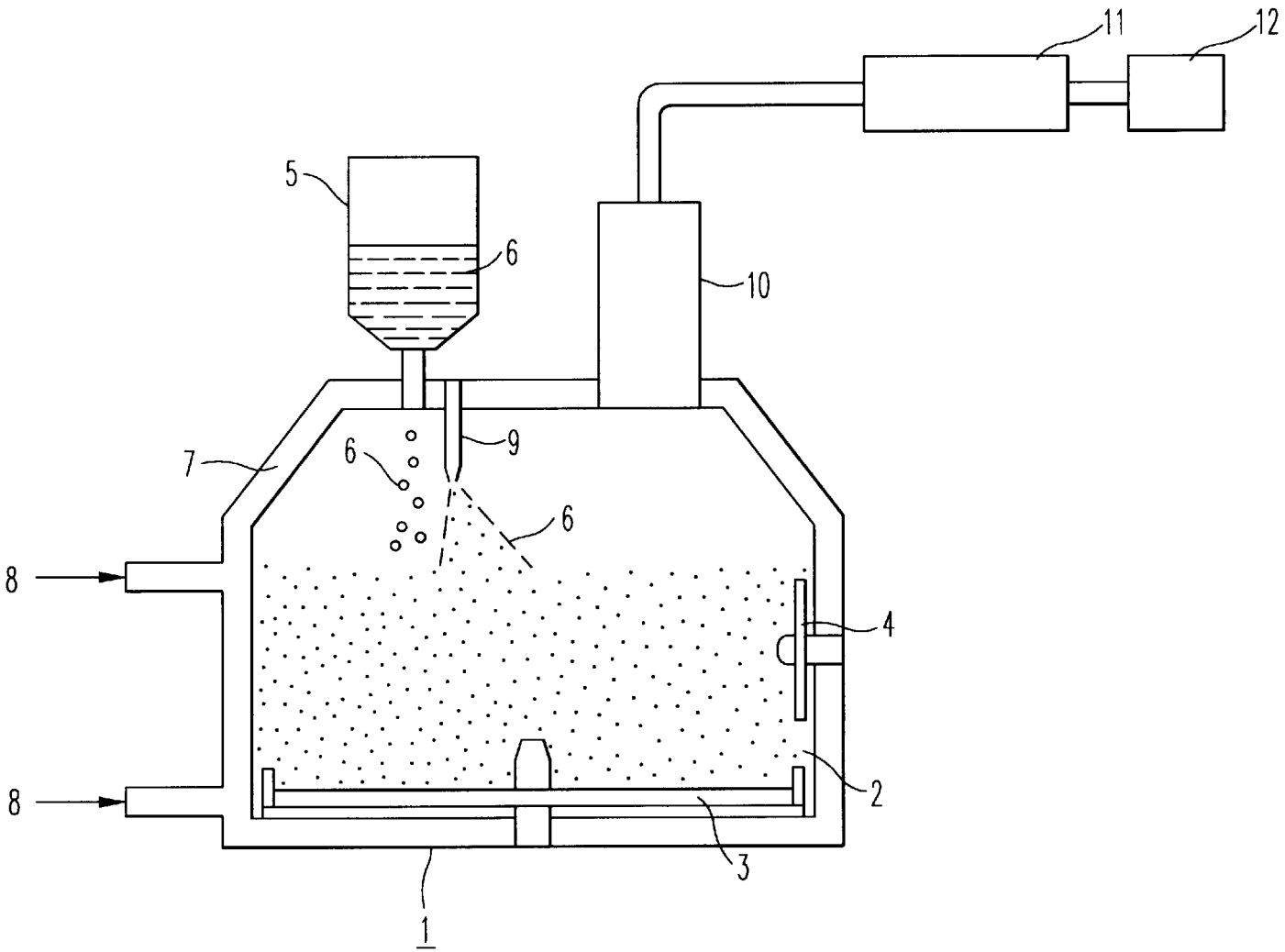
FIG. 4 is a schematic view illustrating an embodiment of coating apparatus using a carrier manufacturing method of the present invention.

An embodiment of a coating apparatus for use in the present invention is illustrated in FIG. 4. The coating apparatus has a coating vessel 1 and which can reduce its atmosphere so that the pressure is below ordinary pressure, i.e., 760 mm Hg, using a vacuum pump 12. In addition, the coating vessel 1 has a mixing blade 3 which can mix and agitate carrier particles 2 to make the carrier particles 2 circulate in the vessel 1, and a pulverizing blade 4, which can release agglomerated carrier particles. Further, the coating vessel 1 has a jacket 7 which can cool or heat the vessel 1. A heating medium 8 is circulated through the jacket 7 to heat the vessel 1. A coating liquid 6 is in a container 5 and poured into the vessel 1 when dip coating is performed. The coating liquid is dripped into the vessel 1 when drip coating is performed, and sprayed from a nozzle 9 into the vessel 1 when a spray coating is performed. A solvent in the coating liquid is evaporated by heating the vessel 1, and the evaporated solvent is transported from the vessel 1 to a solvent recovering apparatus 11 via a bag filter 10.

The volume resistivity of the carrier particles 2 can be controlled by controlling the rotating speed of the mixing blade 3, the pressure in the vessel 1 and drying time, or by subjecting them to an additional heat treatment.

The pressure of the atmosphere in the coating vessel 1 is preferably from about 260 to about 710 mmHg. When the pressure is greater than the upper limit, the evaporation speed of the solvent included in the coating liquid 6 is slow and therefore it takes a long time to dry the coated resin layer. In addition, when the pressure is greater than the upper limit, adhesion between the carrier and the coated resin layer deteriorates because voids present on the surface of the carrier particles 2 cannot be removed therefrom when the resin layer is coated. If a carrier having poor adhesion to the coated resin layer is then subjected to the following heat treatment, the coated resin layer tends to release from the carrier particles 2 by stress applied from the outside. On the other hand, when the pressure is less than the lower limit, the resin to be coated on the surface of the carrier is removed from the vessel 1 together with the solvent in the coating liquid 6, resulting in an increase of thin layer rate. Therefore, the desired image qualities cannot be obtained because the resistivity and the charging ability of the coated carrier decreases. In addition, the carrier particles 2 tend to be removed from the vessel 1, and yield of the coated carrier is reduced.

In the present invention, a coated carrier is heated to evaporate the solvent in the coating liquid 6, preferably at a temperature between a temperature lower than the boiling point of the solvent by about 10° C. and another temperature higher than the boiling point by about 10° C. to effectively dry the solvent and to maintain the spectrum intensity in the desired range.

In the coating and drying processes of the dip coating method of the present invention, the rotating speed of the mixing blade 3 is preferably from about 1.4 to about 2.0 m/sec to coat a resin layer on the entire surface of the carrier particles 2 and to prevent reduction of yield of coated carrier particles when the solvent in the coating liquid 6 is evaporated. In addition, the rotating speed of the mixing blade 3 is preferably from about 2.5 to about 5.5 m/sec to prevent the coated carrier from agglomerating and to prevent the coated resin layer from wearing out after the solvent in the coating liquid 6 is evaporated. If the coated resin layer is worn out in the vessel 1 and resin powders are formed, the resin powders adhere to the surface of the resin coated carrier, resulting in an increase in the resistivity of the resin coated carrier. In addition, resin powders adhering to the carrier deteriorate the charging ability of the coated carrier.

Similarly, in the coating and drying processes of the spraying and drip coating methods, the rotating speed of the mixing blade 3 is preferably from about 1.4 to about 2.0 m/sec while the coating liquid 6 is sprayed or dripped, and preferably from about 2.5 to about 5.5 m/sec after the spraying or dripping is finished.

In the present invention, a silicone resin layer is formed, for example, by the following dip coating method:

(1) a silicone resin solution and a coupling agent are mixed and dispersed using a mixer to prepare a resin layer coating liquid 6;

(2) carrier particles 2 are contained in the coating vessel 1 with the jacket 7 and the vessel 1 is heated to a desired temperature by heating the jacket 7;

(3) when the carrier particles 2 are heated to the desired temperature, the previously prepared resin layer coating liquid on 6 is added to the vessel 1 so that the carrier particles 2 are dipped in the coating liquid 6;

(4) the pressure in the vessel is reduced to the desired pressure, and then the carrier particles 2 are mixed and agitated with the mixing blade 3, and dried to obtain a coated carrier.

The thus obtained carrier is mixed with a toner to obtain a two-component developer so that the weight ratio of the carrier and the toner is about 100/0.5 to about 100/6.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of coated carrier A

The following components were mixed with a homomixer for ten minutes to prepare a resin layer coating liquid.

| | |
|---|---|
| Silicone resin solution (SR2411 manufactured by Dow Corning-Toray Silicone Co., Ltd., solid content of 20% by weight) | 200 parts |
| γ-(2-aminoethyl)aminopropyl trimethoxysilane | 6 parts |
| Toluene | 200 parts |

Two thousand (2000) parts by weight of a ferrite carrier having an average particle diameter of 50 μm (F-300 manufactured by Powdertec Co., Ltd) were placed in a multifunctional mixer with a jacket manufactured by Fukae Industry Co., Ltd. The jacket was heated to 100° C., and the ferrite carrier was mixed by rotating a mixing blade and a pulverizing blade so that the temperature of the ferrite carrier was 100° C. Four hundred (400) parts of the resin layer coating liquid were added to the mixer, and the pressure of the atmosphere in the mixer was reduced to 410 mmHg. The ferrite carrier was then coated with the coating liquid and dried while the mixing blade was rotated at a speed of 1.5 m/sec before the solvent of the coating liquid was evaporated and at a speed of 5.0 m/sec after the solvent of the coating liquid was evaporated.

The carrier was then subjected to a low heat treatment to obtain a carrier A. The thin layer rate of the carrier A was 75.5% and the thicknesses of the thin layer part and the thick layer part of the coated resin layer were 0.06 and 6.2 μm, respectively. Each spectrum intensity of chloroform-soluble components of the carrier A in three infrared regions from 1000 to 1200 $cm^{-1}$, from 1200 to 1300 $cm^{-1}$ and from 700 to 900 $cm^{-1}$ were 0.91, 0.52 and 0.47 respectively.

Preparation of toner A

The following components were mixed and kneaded with a heated roll mill and then cooled to obtain a toner block.

| | |
|---|---|
| Polyester resin (Mn = 5000, Mw = 55000, Tg = 61° C.) | 95 parts |
| Styrene-acrylate copolymer (manufactured by Sanyo Chemical Industries Ltd.) | 20 parts |
| Symuler Fast Yellow (manufactured by Dainippon Ink and Chemicals, Inc. | 5 parts |
| Bontron E-84 (manufactured by Orient Chemical Industries Co., Ltd.) | 1 part |

The toner block was then pulverized and the resultant toner particles were classified to prepare a yellow toner A having an average particle diameter of 7 μm.

Preparation of developer A

The carrier A and the toner A were mixed in a ratio of 95/5 using a ball mill to prepare developer A.

Example 2

Preparation of carrier B

The procedure for preparation of carrier A in Example 1 was repeated to obtain carrier B, except that the rotating speeds of the mixing blade before and after the solvent were evaporated was 1.4 and 3.0 m/sec, respectively, and the temperature of the jacket was 120° C. The thin layer rate of carrier B was 60% and the thicknesses of the thin layer part and the thick layer part of the coated resin layer were 0.08 and 4.1 μm, respectively. The spectrum intensity of chloroform-soluble components of carrier B in three infrared regions from 1000 to 1200 $cm^{-1}$, from 1200 to 1300 $cm^{-1}$ and from 700 to 900 $cm^{-1}$ were 0.86, 0.48 and 0.45 respectively.

Preparation of developer B

The procedure for preparation of developer A was repeated to prepare developer B except that the carrier A was replaced with the carrier B.

Example 3

Preparation of carrier C

The procedure for preparation of the carrier A in Example 1 was repeated to obtain carrier C except that the pressure of the atmosphere in the mixer was 260 mmHg and the temperature of the jacket was 110° C. The thin layer rate of the carrier C was 80% and the thicknesses of the thin layer part and the thick layer part of the coated resin layer were 0.1 and 5.5 μm, respectively. The spectrum intensity of chloroform-soluble components of carrier C in three infrared regions from 1000 to 1200 $cm^{-1}$, from 1200 to 1300 $cm^{-1}$ and from 700 to 900 $cm^{-1}$ were 0.85, 0.46 and 0.45 respectively.

Preparation of toner B

The following components were mixed and kneaded with a heated roll mill and then cooled to obtain a toner block.

| | |
|---|---|
| Polyester resin (Mw = 250000) | 85 parts |
| carnauba wax substantially free from aliphatic acids (acid value of 2 mgKOH) | 5 parts |
| Carbon black (#44 manufactured by Mitsubishi Chemical Corp.) | 10 parts |
| Azo dye including chromium (Bontron S34, manufactured by Orient Chemical Industries Co., Ltd.) | 1 part |

The toner block was then pulverized and the resultant toner particles were classified to prepare a black toner having an average particle diameter of 8 μm. One hundred (100) parts of the black toner and two parts of a colloidal silica were then mixed to prepare a yellow toner B.

Preparation of developer C

The carrier C and the toner B were mixed in a ratio of 95/5 using a ball mill to prepare developer C.

Example 4

Preparation of carrier D

The procedure for preparation of carrier A in Example 1 was repeated to obtain carrier D except that the dip coating method was changed to a spray coating method in which 400 g of the resin layer coating liquid was sprayed at a flow rate of 30 ml/min, the pressure of the atmosphere in the mixer was 610 mmHg, the rotating speed was 1.8 m/sec while the coating liquid was being sprayed and 4.0 m/sec after the spraying of the coaling liquid was finished, and the low heat treatment was changed to a middle heat treatment. The thin layer rate of carrier D was 72% and the thicknesses of the thin layer part and the thick layer part of the coated resin layer were 0.07 and 6.9 um, respectively. The spectrum intensity of chloroform-soluble components of carrier D in three infrared regions from 1000 to 1200 $cm^{-1}$, from 1200 to 1300 $cm^{-1}$ and from 700 to 900 $cm^{-1}$ were 0.79, 0.41 and 0.42 respectively.

Preparation of developer D

The carrier D and the toner A were mixed in a ratio of 95/5 using a ball mill to prepare developer D.

Example 5

Preparation of carrier E

The procedure for preparation of carrier D in Example 4 was repeated to prepare carrier E, except that the spray coating method was changed to a drip coating method and the pressure of the atmosphere was 560 mmHg. The thin layer rate of carrier E was 66% and the thicknesses of the thin layer part and the thick layer part of the coated resin layer were 0.8 and 7.0 μm, respectively. The spectrum intensity of chloroform-soluble components of carrier E in three infrared regions from 1000 to 1200 $cm^{-1}$, from 1200 to 1300 $cm^{-1}$ and from 700 to 900 $cm^{-1}$ were 0.78, 0.42 and 0.43, respectively.

Preparation of developer E

The carrier E and the toner A were mixed in a ratio of 95/5 using a ball mill to prepare developer E.

Example 6

Preparation of carrier F

The procedure for preparation of carrier A in Example 1 was repeated to prepare carrier F, except that the rotating speeds of the mixing blade before and after the solvent was evaporated were 2.0 and 5.5 m/sec, respectively; the pressure of the atmosphere in the mixer was 660 mmHg, and the temperature of the jacket was 115° C. The thin layer rate of the carrier B was 78% and the thicknesses of the thin layer part and the thick layer part of the coated resin layers were 0.07 and 6.30 μm, respectively. The spectrum intensity of chloroform soluble components of the carrier B in three infrared regions from 1000 to 1200 $cm^{-1}$, from 1200 to 1300 $cm^{-1}$ and from 700 to 900 $cm^{-1}$ were 0.90, 0.49 and 0.51 respectively.

Preparation of developer F

The carrier F and the toner A were mixed in a ratio of 95/5 using a ball mill to prepare developer F.

Comparative Example 1

Preparation of Comparative Carrier 1

A resin layer coated ferrite carrier was prepared with a fluidized bed type spray coating machine, Spiracoater SP40 manufactured by Okada Seiko Co., Ltd., using the same ferrite carrier and the resin layer coating liquid prepared in Example 1. The temperature in the coating machine was 100° C. and the flow rate of the coating liquid was 30 ml/min. Thus a comparative carrier 1 was prepared. The thin layer rate of the comparative carrier 1 was 12% and the thicknesses of the thin layer part and the thick layer part of the coated resin layer were 0.17 and 0.81 μm, respectively. The spectrum intensity of chloroform-soluble components of carrier B in three infrared regions from 1000 to 1200 $cm^{-1}$, from 1200 to 1300 $cm^{-1}$ and from 700 to 900 $cm^{-1}$ were 0.85, 0.46 and 0.44, respectively.

Preparation of Comparative Developer I

The Comparative Carrier 1 and the toner A were mixed in a ratio of 95/5 using a ball mill to prepare Comparative Developer 1.

Comparative Example 2

Preparation of Comparative Carrier 2

The procedure for preparation of carrier A in Example 1 was repeated to prepare Comparative Carrier 2 except that the pressure of the atmosphere in the mixer was 660 mmHg, the rotating speed of the mixing blade was constant (2.0 m/sec) through the coating and the drying processes, and the temperature of the jacket was 90° C. The thin layer rate of Comparative Carrier 2 was 35% and the thicknesses of the thin layer part and the thick layer part of the coated resin layer were 0.07 and 4.6 μm, respectively. The spectrum intensity of chloroform-soluble components of Comparative Carrier 2 in three infrared regions from 1000 to 1200 $cm^{-1}$, from 1200 to 1300 $cm^{-1}$ and from 700 to 900 $cm^{-1}$ were 0.87, 0.44 and 0.45, respectively. When the resultant carrier was visually observed, there were many agglomerated carrier particles in the resin coated carrier.

Preparation of Comparative Developer 2

Comparative Carrier 2 and toner A were mixed in a ratio of 95/5 using a ball mill to prepare Comparative Developer 2.

The resistivity of carriers A to F and Comparative Carriers 1 and 2, and the durability of developers A to F and Comparative Developers 1 and 2 were evaluated. The results are shown in Table 1.

Measuring methods

1. Resin layer thickness and thin layer rate 1-1. Pretreatment of Carrier

The surface of a resin coated carrier particle was coated with platinum by a vacuum evaporation method.

1-2. X-ray Micro-analyzing

Silicon included in the resin layer of the resin coated carrier particle was determined with an X-ray micro analyzer (EPMA-8705 manufactured by Shimazu Corp.) to map the distribution of silicon of the surface of the resin coated carrier.

1-3. Image Processing

The mapped micrograph was then translated into a color image so that, the larger the X-ray intensity a part of the micrograph had, the darker the corresponding part of the image was colored. The translated color image was then inputted to a personal computer, Macintosh LG630, using a scanner, Scan Jet manufactured by Hewlett Packard. Areas of the color image whose X-ray intensity was greater than a specified value were selected.

1-4. Measurement of Resin Layer Thickness of Coated Carrier

The coated carrier particles used in 1-1 and 1-2 were then subjected to treatments which are described below and the cross section thereof was observed with an electron microscope to measure the thickness of the resin coated carrier particle.

Pretreatment Method (1) Au Coating

The carrier particles were coated with gold using an ion sputtering apparatus, E101 manufactured by Hitachi Ltd. The ion sputtering operation was performed under a condition of 10 to 20 mA in current and 5 minutes in time. This ion sputtering operation was performed three times.

(2) Burying Treatment

The Au coated carrier was mixed with a powder component of a wrapping agent, Technovit 4071, in a weight ratio of 4/1 and the mixture was then mixed with a solvent component of the wrapping agent in a weight ratio of 10/1. The mixture was contained in a capsule to prepare a resin including the carrier particle.

(3) Slicing

The resin including the carrier particles was then sliced into a film of 0.7 to 1.5 mm in thickness with a Buehler Isocut Low Speed Saw.

(4) Lapping

The film was lapped with an imperial lapping film sheet manufactured by 3M for 5 minutes so that the cross section of the carrier could be observed.

(5) Ion Polishing

The cross section was polished with a polishing device, E-3200 Flat Milling Device manufactured by Hitachi Ltd., under the following conditions:

Acceleration voltage: 3 KV

Ion irradiation angle: 10 degree

Sputtering time: 5 hours.

Determination of resin layer thickness

The thus prepared cross section of the carrier particle was observed with a scanning electron microscope, S-4500 (FE-SEM) manufactured by Hitachi Ltd. Thickness was measured at ten points in each of the thin layer part and the thick layer part of the resin coated carrier, and averaged to obtain the average thickness of each of the thin layer part and the thick layer part.

Determination of thin layer rate

Thick layer parts whose thickness was five or more times as thick as the averaged thickness of the thin layer part were colored black in the colored image obtained in 1-3. The residual area of the colored image was colored white. The area of the black colored images was summed to obtain an area B of the thick layer parts of the resin coated carrier. The total area A of the surface of the resin coated carrier was obtained using the images obtained in 1-1 and 1-2. The area C of the thin layer parts, namely the white colored areas of the black and white image, was obtained by subtracting the area of the black colored image from the total area A of the surface of the resin coated carrier.

2. Spectrum Intensity of Absorbance of Chloroform-soluble Components 2-1. Pretreatment of Resin Coated Carrier Resin coated carrier particles whose weight was 5±0.05 g were sampled and added to a test tube which contained chloroform whose volume was 10.00±0.05 ml. The mixture was subjected to an ultrasonic treatment for 3 minutes. The mixture was then allowed to settle at room temperature for ten days. Half milliliter (0.50 ml) of the chloroform solution was sampled and dried up using hot air to obtain a residue on evaporation. The residue was mixed with KBr to make a pellet having a volume of 0.5 ml. The spectrum intensity of absorbance of the pellet was measured by an infrared spectroscopy using a Fourier transform infrared spectrophotometer, JIR-100 manufactured by JEOL Ltd. The conditions were as follows:

Sampling rate: 1

Resolution: 4

Time: 30

Position: 800±100 $cm^{-1}$, 1100+100 $cm^{-1}$, and 1250±50 $cm^{-1}$

3. Resistivity of Resin Coated Carrier

Resin coated carrier particles were placed in a container having a pair of parallel electrodes whose gap was 2 mm. A direct current of 200 V was applied to the electrodes and the resistance of the carrier particles was measured 30 seconds after the start of the application of the direct current. The resistance was transformed to a volume resistivity value.

4. Durability of Resin Coated Carrier

Each of developers A–F and comparative developers 1–2 was subjected to a running test in which 800,000 images were continuously reproduced using a copier, PRETER 550 manufactured by Ricoh Co., Ltd., and then subjected to a blow-off treatment to obtain only the used resin coated carrier. A new developer was prepared using the used resin coated carrier and new yellow toner. The charging mount of the developer was measured to obtain the ratio of the charging amount of the new developer to that of the initial developer before the running test. The ratio was ranked to obtain a durability index such that the index was 0 when the ratio was 1. The smaller than 1 the ratio becomes, the larger negative value the index becomes, and the larger than 1 the ratio becomes, the larger positive value the index becomes. In addition, the resin layer thickness and the thin layer rate were also measured in the same way as performed in 1.

5. Image Qualities 5-1. Fouling in Background of Developed Image

An initial developed image obtained in the running test using each developer was evaluated with respect to fouling in the background of the image. The fouling was ranked using numerals from 1 to 5; the larger the numeral, the more fouling.

5-2. Dark Color Problem

Developed images obtained in the running test using each developer were visually observed for the occurrence of a dark color problem.

TABLE 1

| | volume resistivity in logarithmic scale (Ω · cm) | Durability index | Fouling in background of developed image | Dark color problem |
|---|---|---|---|---|
| Example 1 | 9.70 | −10 | 5 | not occurred |
| Example 2 | 13.20 | −7 | 3 | not occurred |
| Example 3 | 9.10 | −11 | 5 | not occurred |
| Example 4 | 9.20 | −18 | 5 | not occurred |
| Example 5 | 11.90 | −15 | 4 | not occurred |
| Example 6 | 8.80 | −9 | 5 | not occurred |
| Comparative Example 1 | 15.70 | −25 | 1 | not occurred |
| Comparative Example 2 | 15.20 | −23 | 2 | not occurred |

The results shown in Table 1 clearly indicate that the resin coated carriers of the present invention have good volume resistivity in spite of the absence of an electroconductive agent, and have good durability, producing images having good image qualities.

This application is based on Japanese Patent Application No. 09-217030, filed on Jul. 29, 1997, incorporated therein by reference.

Having now fully described the invention, it will be apparent to one of ordinary skill in the art that many changes and modifications can be made thereto without departing from the spirit and scope of the invention as set forth therein.

We claim:

1. A carrier for a two-component developer for electrostatic latent images comprising: carrier particles whose surfaces have convex parts and concave parts and is coated with a resin layer comprising a thermosetting resin, wherein the resin layer forms a thin resin layer on the convex parts and forms a thick resin layer on the concave parts, and wherein the ratio of the total area of the thin resin layer to the total surface area of the carrier particles is from about 55% to about 90%.

2. The carrier of claim 1, wherein a ratio of the thickness of the thin resin layer to the thickness of the thick resin layer is from about 1/2 to about 1/100.

3. The carrier of claim 1, wherein the thermosetting resin comprises a silicone resin.

4. The carrier of claim 3, wherein the resin layer further comprises a silane coupling agent.

5. The carrier of claim 4, wherein the silane coupling agent comprises an amino group.

6. The carrier of claim 4, wherein the silane coupling agent comprises at least one of a chlorine atom and a glycidoxy group.

7. The carrier of claim 1, wherein the spectrum intensity in Abs mode of absorbance of chloroform-soluble components of the resin coated carrier is greater than about 0.8 in the infrared range of 1000 to 1200 $cm^{-1}$ in wave number, which is measured by the following KBr-pellet method:

volume of pellet: 0.5 ml;

infrared spectrophotometer: a Fourier transform infrared spectrophotometer, JIR-100 manufactured by JEOL Ltd.;

sampling rate: 1;

resolution: 4;

time: 30; and position: 1100±100 $cm^{-1}$.

8. The carrier of claim 1, wherein each spectrum intensity in Abs mode of absorbance of chloroform-soluble components of the resin coated carrier in infrared ranges from 700 to 900 $cm^{-1}$ and from 1200 to 1300 $cm^{-1}$ is greater than about 0.45, measured by Kbr-pellet at 800±100 $cm^{-1}$ and 1250±50 $cm^{-1}$, respectively, using a Fourier transform infrared spectrophotometer, JIR-100 manufactured by JEOL Ltd.; sampling rate: 1; resolution: 4; time: 30.

9. The carrier of claim 1, wherein the resin layer of the carrier is free from an electroconductive agent.

10. A method for manufacturing a carrier for a two-component developer for electrostatic latent images comprising the steps:

preparing a coating liquid comprising a thermosetting resin and a solvent;

coating the coating liquid on surfaces of carrier particles which have convex parts and concave parts, in a coating vessel, by either a dip coating method, a spray coating method or a drip coating method; and drying the coating liquid to form a resin layer on the surface of the carrier particles, wherein the resin layer forms a thin resin layer on the convex parts and forms a thick resin layer on the concave parts, and wherein the ratio of total area of the thin resin layer to the total surface area of the carrier particles is from about 55% to about 90%, wherein the coating and drying steps are performed under reduced pressure while heating.

11. The method of claim 10, wherein the coating vessel has a mixing blade which mixes and agitates the carrier particles and the coating is performed by the dip coating method, and wherein the mixing blade is rotated at a rotating speed of about 1.4 to about 2.0 m/sec while the solvent is being evaporated, and rotated at a rotating speed of about 2.5 to about 5.5 m/sec after the solvent is evaporated.

12. The method of claim 10, wherein the coating vessel has a mixing blade which mixes and agitates the carrier particles and the coating is performed by either the spray coating method or the drip coating method, and wherein the mixing blade is rotated at a speed of about 1.4 to about 2.0 m/sec while the coating liquid is being sprayed or dripped, and rotated at a speed of about 2.5 to about 5.5 m/sec after the coating liquid is sprayed or dripped.

13. The method of claim 10, wherein the reduced pressure is about 260 mmHg to about 710 mmHg.

14. The method of claim 10, wherein the heating step is performed at a temperature between a temperature lower than the boiling point of the solvent by about 10° C. and a temperature higher than the boiling point of the solvent by about 10° C.

* * * * *